United States Patent [19]

Goudreau et al.

[11] 4,373,211

[45] Feb. 15, 1983

[54] PROTECTIVE CHEST SHIELD

[75] Inventors: Noel Goudreau, Bourbonnais; Nick Colevris, Bradley; Carl Southard, Bourbonnais, all of Ill.

[73] Assignee: Trico Products Incorporated, Bradley, Ill.

[21] Appl. No.: 285,959

[22] Filed: Jul. 23, 1981

[51] Int. Cl.[3] ..... A41D 13/00

[52] U.S. Cl. ..... 2/2

[58] Field of Search ..... 2/2, 2.5, 16, 20, 22, 2/24, 412, 411

[56] References Cited

U.S. PATENT DOCUMENTS

| | | | |
|---|---|---|---|
| 2,553,612 | 5/1951 | Taylor | 2/22 |
| 3,268,912 | 8/1966 | Whelan | 2/22 |
| 3,945,041 | 3/1976 | Rhee | 2/2 |
| 4,272,847 | 6/1981 | Buhler | 2/2 |

FOREIGN PATENT DOCUMENTS

| | | | |
|---|---|---|---|
| 5615 | 11/1979 | European Pat. Off. | 2/2 |

*Primary Examiner*—Richard J. Scanlan, Jr.
*Attorney, Agent, or Firm*—Anthony S. Zummer

[57] ABSTRACT

The present invention relates to an improved protective chest shield particularly adapted for use in sporting events. The protective chest shield includes an elongated pad having enlarged portions at both ends. The pad includes an inner layer of closed cell polyvinyl chloride foam and an outer layer of polypropylene. The pad has a plurality of apertures extending therethrough. Each of the apertures extending through the polypropylene is beveled having the larger end spaced away from the polyvinyl chloride foam. A fabric strap extends through a pair of proposed apertures adjacent to opposite ends of the pad but adjacent to the same edge. The fabric strap extends through a second pair of apertures adjacent to the same ends and the opposite edge. The fabric strap is adapted for tying together to provide a means for holding the protective chest shield onto a wearer.

9 Claims, 4 Drawing Figures

FIG. 1
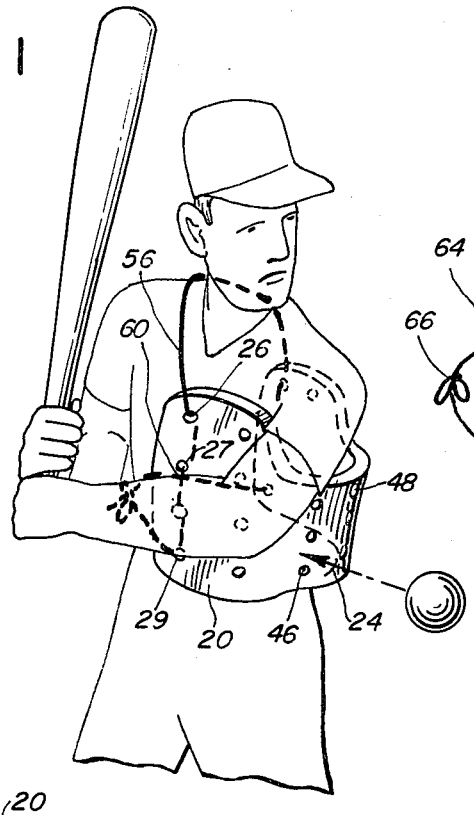
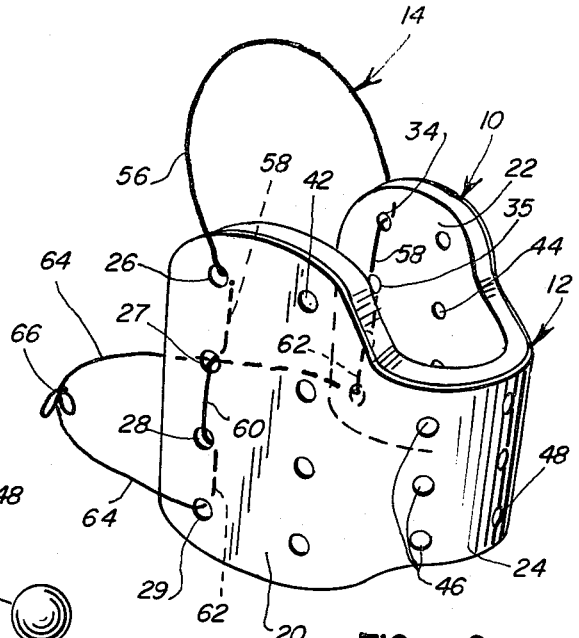
FIG. 2
FIG. 3
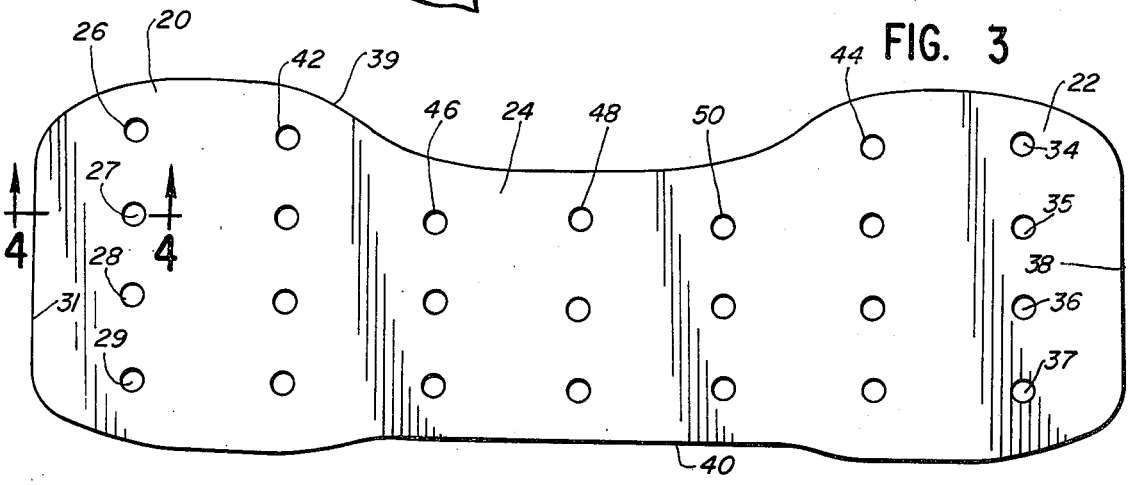
FIG. 4
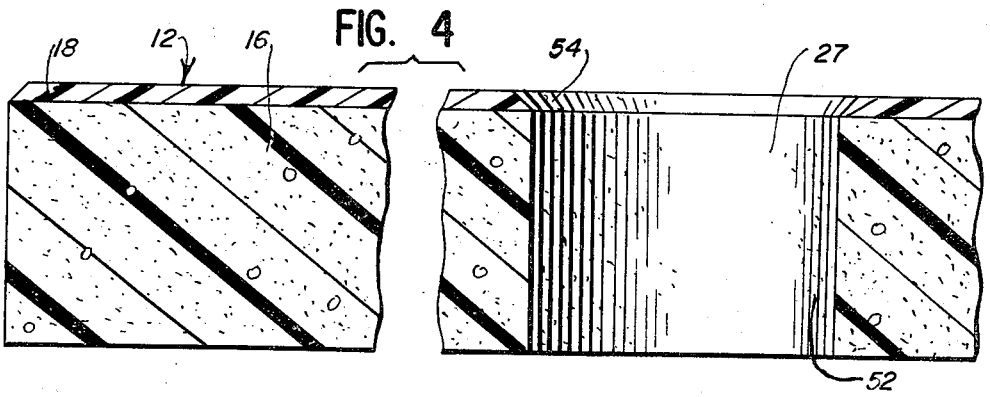

PROTECTIVE CHEST SHIELD

BACKGROUND OF THE INVENTION

In playing certain sports such as baseball, a ball is hurled toward an opposing player. Certain participants in a baseball game customarily wear protective shields over their chests, such as, the catcher or the plate umpire. The batter customarily does not wear a protective chest shield because the protective shields are often cumbersome and hard to hold in position. In addition, protective shields are difficult to apply, because straps must be adjusted after the straps are placed into position. In addition, the shields are often quite expensive. The broad concept of a protective chest shield is taught in U.S. Pat. No. 389,745 to Henry Gross, issued Sept. 18,1888. The concept of providing a specific protective device for a batter is taught in U.S. Pat. No. 2,990,546 to C. F. Doughty, issued July 4, 1961. This protective chest shield requires several straps to be buckled in order for the shield to be secured to a batter. Use of a closed cell foam material is taught in U.S. Pat. No. 3,248,738 to G. E. Morgan, issued May 3, 1966.

Although the broad concept of protective chest shields for use by batters is well-known, it is desirable to provide an inexpensive protective chest shield which may be readily donned by a batter.

SUMMARY OF THE INVENTION

The present invention relates to an improved protective chest shield and particularly to a protective chest shield adapted for use by a batter in a baseball game. The protective chest shield consists of an elongated pad with opposite ends being enlarged to wrap around a portion of a batter's torso on the side of the torso adjacent to the pitcher to provide an enlarged shield portion on the chest and the back. The pad includes a layer of polyvinyl chloride closed cell foam and a layer of polypropylene secured to the foam with the polypropylene being on the exterior of the pad. A plurality of apertures is formed in the pad. Each of the apertures extends through the polypropylene and the foam. The apertures in the polypropylene are beveled with the enlarged portion being adjacent to the exterior surface. A single fabric strap extends through a pair of opposed apertures at each end of the pad, which apertures are positioned along the upper edge of the pad. That portion of the strap between the pair of apertures is particularly adapted to pass over a wearer's shoulder. The strap extends from the first mentioned pair of apertures to a second pair of apertures, which second pair of apertures are also positioned adjacent to each end of the pad and positioned along the lower edge of the pad. Opposite ends of the strap extend through each of the apertures of the second pair and those ends are adapted to be wrapped around a portion of the wearer's torso to hold the enlarged ends of the pad against a wearer's chest and back respectively. The free ends of the fabric strap are adapted to be tied together to hold the pad in position. Since the fabric strap is a single strap, the strap may be moved in the apertures so that the protective chest shield may be adjusted to a selected location on the torso and held in position by tying the ends of the fabric strap together.

BRIEF DESCRIPTION OF THE DRAWINGS

FIG. 1 is a perspective view showing a protective chest shield embodying the herein disclosed invention mounted on a batter;

FIG. 2 is a perspective view of the protective chest shield shown in FIG. 1;

FIG. 3 is a plan view of the pad of the protective chest shield shown in FIG. 2, showing the pad in a flat attitude; and FIG. 4 is an enlarged fragmentary cross sectional view taken on line 4—4 of FIG. 3 showing the form of an aperture through the pad.

DESCRIPTION OF THE PREFERRED EMBODIMENT

Referring now to the drawings and especially to FIG. 2. A protective chest shield embodying the present invention is shown therein, and generally indicated by numeral 10. The protective chest shield generally consists of a pad 12 and a strap 14 movably mounted in the pad for holding the pad onto a wearer as shown in FIG. 1.

Pad 12 includes a sheet 16 of a polyvinyl chloride closed cell foam having a thickness of three-eighths of an inch. A polypropylene sheet 18 is secured to the polyvinyl chloride foam. The polypropylene has a thickness of forty mils, and is co-extensive with the polyvinyl chloride foam.

Looking now to FIG. 3, it may be seen that pad 12 is elongated and has an enlarged portion 20 on one end and a mirror image enlarged portion 22 on the other end. A narrower central portion 24 extends between enlarged portions 20 and 22.

Pad 12 has a plurality of identical apertures contained therein to provide ventilation and to provide a means for movably connecting strap 14 to the pad. As may be seen in FIG. 3, enlarged portion 20 has apertures 26, 27, 28 and 29 aligned adjacent to edge 31. Enlarged portion 22 includes apertures 34, 35, 36 and 37 aligned to the opposite edge 38, which is parallel to edge 31. Aperture 26 is positioned adjacent to upper edge 39 as is aperture 34, which is in opposite enlarged portion 22. Apertures 29 and 37 are positioned adjacent to lower edge 40. A line of four apertures 42 is aligned parallel to apertures 26, 27, 28 and 29, and a line of four apertures 44 is aligned parallel to apertures 34, 35, 36 and 37. Central portion 24 contains three parallel lines of apertures 46, 48 and 50, each of which lines of apertures has three apertures in a particular line.

Each of the apertures is identical in construction to each other aperture. FIG. 4 is an enlarged view of aperture 27 showing the form of the aperture. Aperture 27 extends through polyvinyl chloride foam sheet 16 and has a cylindrical portion 52 through that foam sheet. Aperture 27 includes a flaired portion 54 in the polypropylene sheet so that the polypropylene sheet has a beveled edge defining the aperture. The flaired portion has its smaller portion adjacent to the polyvinyl chloride closed cell foam sheet and aligned with the cylindrical portion 52.

Strap 14 is fabric and has a shoulder portion 56, which is adapted to engage a wearer's shoulder. One end of the shoulder portion is positioned in aperture 26 and the other end is positioned in aperture 34. The strap includes a pair of identical inner upper portions 58 which extend to apertures 27 and 35. The strap extends through apertures 27 and 35 and includes a pair of identical outer portions 60. Strap outer portions 60 extends through apertures 28 and 36 and the strap extends through apertures 28 and 36 to a pair of identical lower inner portions 62. The strap extends through apertures 29 and 37 to a pair of identical tie portions 64, which may be tied into a knot 66.

The instant protective chest shield may be easily and quickly applied to a wearer simply by placing the shoulder portion over a wearer's head to place the pad in engagement with the wearer's torso, as shown in FIG. 1. Pad 12 is wrapped around the chest and the back of the wearer. By adjusting the outer portions 60, the pad may be vertically adjusted on the wearer. Once the pad is adjusted vertically, the tie portions 64 are pulled to place the enlarged portions 20 and 22 in proximity to the chest and the back of the wearer's torso. Knot 66 is tied to hold the pad in position. As is evident in FIG. 1, the pad protects the wearer's ribs with the central portion 24. Enlarged portion 20 extends over the wearer's chest to protect the wearer's heart. It has been found that although a ball may be hurled at a high speed, the present construction protects the wearer inasmuch as, the initial impact is taken up by the polypropylene sheet and the impact is cushioned by the polyvinyl chloride closed cell foam.

It should further be appreciated that the subject protective chest shield may be worn either by a right handed or a left handed batter; that is, the shield is adapted for protecting either a right handed or a left handed batter, so that it is not necessary to stock a large number of shields. In addition, the protective chest shield may be applied quickly and efficiently simply by adjusting the strap of the shield onto a batter and tying a single knot to keep the adjustment and to hold the shield in position.

The beveled construction of the apertures is such that fabric strap 14 is not quickly worn by the fabric strap rubbing on a sharp edge of each of the apertures. It may be appreciated that the hard polypropylene sheet is beveled so that there is no sharp edge to engage the fabric strap; thus, the wear on the fabric strap is minimized without sacrificing any of the protective aspects of the subject chest shield.

It is readily apparent that the subject chest shield has a plurality of apertures extending through the closed cell foam and the polypropylene sheet to allow the chest shield to have ventilating paths through the sheet without disturbing the operation of the shield. It has been found that the apertures having a one-half inch diameter are effective for ventilating the wearer and providing protection to the batter. It may be appreciated that a batter, such as the individual depicted in FIG. 1, receives a substantial amount of protection from the subject protective chest shield.

It may be readily appreciated that the subject protective chest shield may be easily removed by a batter after he has completed batting. Knot 66 need only be loosened to loosen the tie portions of the strap and the strap may be pulled through the holes in order to loosen the shoulder portion. The protective chest shield may be readily and conveniently removed.

Although a specific embodiment of the herein disclosed invention has been described in detail above and shown in the accompanying drawings, those skilled in the art may make various modifications and changes in the instant invention without departing from the spirit and scope of the present invention. It is to be expressly understood that the instant invention is limited only by the appended claims.

What is claimed is:

1. A protective chest shield comprising: a uniform cushion sheet of polyvinyl chloride closed cell foam being adapted for positioning adjacent to a wearer's body, a uniform rigid sheet of polypropylene secured to the sheet of polyvinyl chloride foam and being substantially co-extensive therewith, said rigid sheet and said cushion sheet having aligned apertures extending therethrough, each aperture having its outer periphery in the cushion sheet aligned with its outer periphery in the portion of the rigid sheet adjacent to the cushion sheet, a shoulder strap connected to the cushion sheet and to the rigid sheet for supporting the cushion sheet and the rigid sheet, and a chest strap connected to opposite ends of the cushion sheet and the rigid sheet for holding the cushion sheet adjacent to the wearer's chest.

2. A protective chest shield as defined in claim 1 wherein, the apertures in the rigid sheet are circular and beveled having the smaller portion adjacent to the cushion sheet.

3. A protective chest shield as defined in claim 1 wherein, the shoulder strap is fabric.

4. A protective chest shield as defined in claim 1 wherein, the cushion sheet and the rigid sheet are elongated with an enlarged portion on each of a pair of opposite ends.

5. A protective chest shield as defined in claim 1 wherein, the shoulder strap is fabric, and the apertures in the rigid sheet are circular and beveled having the smaller portion adjacent to the cushion sheet.

6. A protective chest shield as defined in claim 1 wherein, the cushion sheet and the rigid sheet are elongated with an enlarged portion on each of a pair of opposite ends of each of the sheets, and the shoulder strap is fabric.

7. A protective chest shield as defined in claim 1 wherein, the cushion sheet is elongated with an enlarged portion on each of a pair of opposite ends, and each of the apertures in the rigid sheet being circular and having a bevel with the smaller portion adjacent to the cushion sheet.

8. A protective chest shield as defined in claim 1 wherein, the cushion sheet is elongated with an enlarged portion on each of a pair of opposite ends, the shoulder strap is fabric, and each of the apertures in the rigid sheet is circular and beveled having the smaller portion adjacent to the cushion sheet.

9. A protective chest shield comprising; a pad including a uniform cushion sheet of polyvinyl chloride closed cell foam having a thickness of at least one-quarter inch and a rigid sheet of polypropylene secured to one side of the cushion sheet, said rigid sheet having a thickness greater than thirty-nine mils, said pad having a plurality of rows of circular apertures contained therein, each of the apertures extending through the rigid sheet and the cushion sheet, each of the apertures in the rigid sheet being beveled having its larger portion on the side spaced away from the cushion sheet, said pad being elongated and having enlarged portions on a pair of opposite ends, and a fabric strap positioned in an apertures adjacent to one edge of one end and in a second aperture adjacent to a like edge at the opposite end of the pad, said strap extending along the pad to a third aperture adjacent to the first end and adjacent to the opposite edge, said strap extending through a fourth aperture positioned adjacent to the second end and adjacent to said opposite edge, said strap being adapted to tie together, whereby a portion of the strap acts as a shoulder support and another portion of the strap serves to hold the pad adjacent to a wearer.

* * * * *